US007837509B1

(12) United States Patent
Switzer

(10) Patent No.: US 7,837,509 B1
(45) **Date of Patent: *Nov. 23, 2010**

(54) RECESSED LIGHT EXTENSION SOCKET

(76) Inventor: Calvin T. Switzer, 3243 Countryclub Pkwy., Castle Rock, CO (US) 80108

( * ) Notice: Subject to any disclaimer, the term of this patent is extended or adjusted under 35 U.S.C. 154(b) by 204 days.

This patent is subject to a terminal disclaimer.

(21) Appl. No.: 12/211,508

(22) Filed: Sep. 16, 2008

Related U.S. Application Data

(60) Continuation of application No. 12/061,729, filed on Apr. 3, 2008, which is a continuation-in-part of application No. 11/613,484, filed on Dec. 20, 2006, now Pat. No. 7,377,817, which is a division of application No. 11/056,178, filed on Feb. 10, 2005, now Pat. No. 7,153,167.

(51) Int. Cl.
*H01R 33/92* (2006.01)

(52) U.S. Cl. ..... 439/642; 362/147

(58) Field of Classification Search ..... 439/313, 439/334, 361, 502, 537, 576, 642, 643, 644, 439/810, 814; 362/147, 391, 403–408, 650
See application file for complete search history.

(56) References Cited

U.S. PATENT DOCUMENTS

| | | | | |
|---|---|---|---|---|
| 394,860 | A | 12/1888 | Dawes | |
| 684,264 | A | 10/1901 | Kemmerer | |
| 806,516 | A | 12/1905 | Berry | |
| 866,473 | A | 9/1907 | Keffe et al. | |
| 1,263,783 | A | 4/1918 | Maier | |
| 1,297,211 | A | 3/1919 | Magness | |
| 1,348,949 | A | 8/1920 | Johanssen | |
| 1,882,312 | A | 10/1932 | Aspinwall | |
| 1,934,624 | A | 11/1933 | Guth | |
| 2,115,898 | A | 5/1938 | Zagora | |
| 2,217,533 | A | 10/1940 | Wolarsky | |
| 2,280,505 | A | 4/1942 | Beck | |
| 2,419,048 | A * | 4/1947 | Althouse | 106/287.24 |
| 2,446,736 | A | 8/1948 | Biller | |
| 2,753,445 | A | 7/1956 | Thomas et al. | |
| 2,767,953 | A | 10/1956 | Wolar | |
| 3,506,232 | A | 4/1970 | Wolar et al. | |
| 4,039,821 | A | 8/1977 | Greene et al. | |
| 4,223,179 | A | 9/1980 | Lusk et al. | |
| 4,232,361 | A | 11/1980 | Kelsall | |
| 4,327,402 | A | 4/1982 | Aubrey | |
| 4,407,560 | A | 10/1983 | Williams | |

(Continued)

OTHER PUBLICATIONS

U.S. Appl. No. 12/061,729, filed Apr. 3, 2008; Inventor: Calvin Switzer.

(Continued)

*Primary Examiner*—Thanh-Tam T Le
(74) *Attorney, Agent, or Firm*—Rick Martin; Patent Law Office of Rick Martin, P.C.

(57) ABSTRACT

A standard ceiling recessed lighting fixture can be modified to a low-slung AC or DC light fixture with a screw-in extender. The extender with bulb can be used to lower a bulb from a recessed lighting fixture a desired length. A series of extension rods can be screwed together for a desired length. Rigid and flexible extenders are disclosed.

23 Claims, 9 Drawing Sheets

U.S. PATENT DOCUMENTS

| | | | | |
|---|---|---|---|---|
| 4,443,052 | A * | 4/1984 | Eaby et al. | 439/322 |
| 4,595,969 | A | 6/1986 | McNair | |
| D298,657 | S | 11/1988 | Flores | |
| 4,783,726 | A | 11/1988 | Wang | |
| 4,952,157 | A | 8/1990 | Hudson et al. | |
| 5,257,172 | A | 10/1993 | Erickson | |
| 5,317,493 | A | 5/1994 | Muller et al. | |
| 5,704,799 | A * | 1/1998 | Wood | 439/281 |
| 6,113,433 | A | 9/2000 | Al-Turki | |
| 6,305,974 | B1 | 10/2001 | Tseng | |
| 6,409,365 | B1 | 6/2002 | Lin | |
| 6,474,829 | B2 | 11/2002 | Clodfelter | |
| 6,523,970 | B1 * | 2/2003 | Scales, III | 362/145 |
| 6,536,927 | B1 | 3/2003 | Lawnicki | |
| 6,679,620 | B2 | 1/2004 | Patz et al. | |
| 6,715,899 | B1 * | 4/2004 | Wu | 362/655 |
| 6,997,740 | B2 | 2/2006 | Kerr | |
| 7,036,954 | B1 | 5/2006 | Cordie et al. | |
| 7,153,167 | B1 * | 12/2006 | Switzer | 439/642 |
| 7,311,425 | B2 | 12/2007 | Jervey, III | |
| 7,329,023 | B2 * | 2/2008 | Mast | 362/147 |
| 7,377,817 | B1 * | 5/2008 | Switzer | 439/642 |
| 7,665,882 | B1 * | 2/2010 | Wang | 362/650 |
| 2003/0161149 | A1 | 8/2003 | Eaton, Jr. | |
| 2003/0235049 | A1 | 12/2003 | Wu | |
| 2007/0014118 | A1 | 1/2007 | Shourds | |

OTHER PUBLICATIONS

U.S. Appl. No. 12/601,729, filed Apr. 3, 2008, Calvin Switzer—Applicant, Office Communication dated May 20, 2010 (PDF—attached).

* cited by examiner

Fig. 1
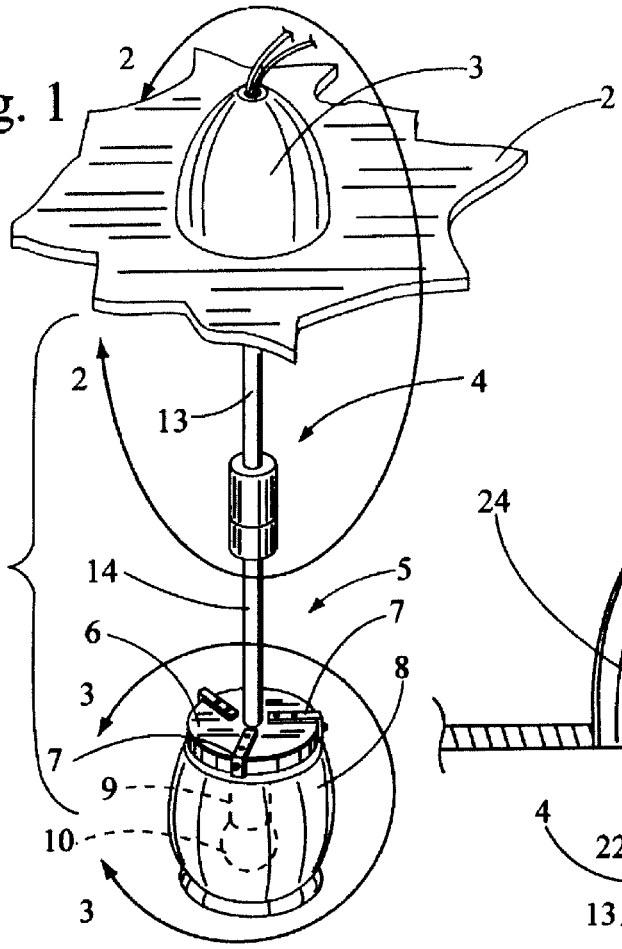
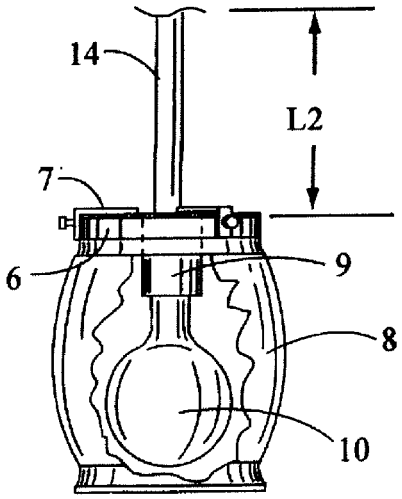
Fig. 3
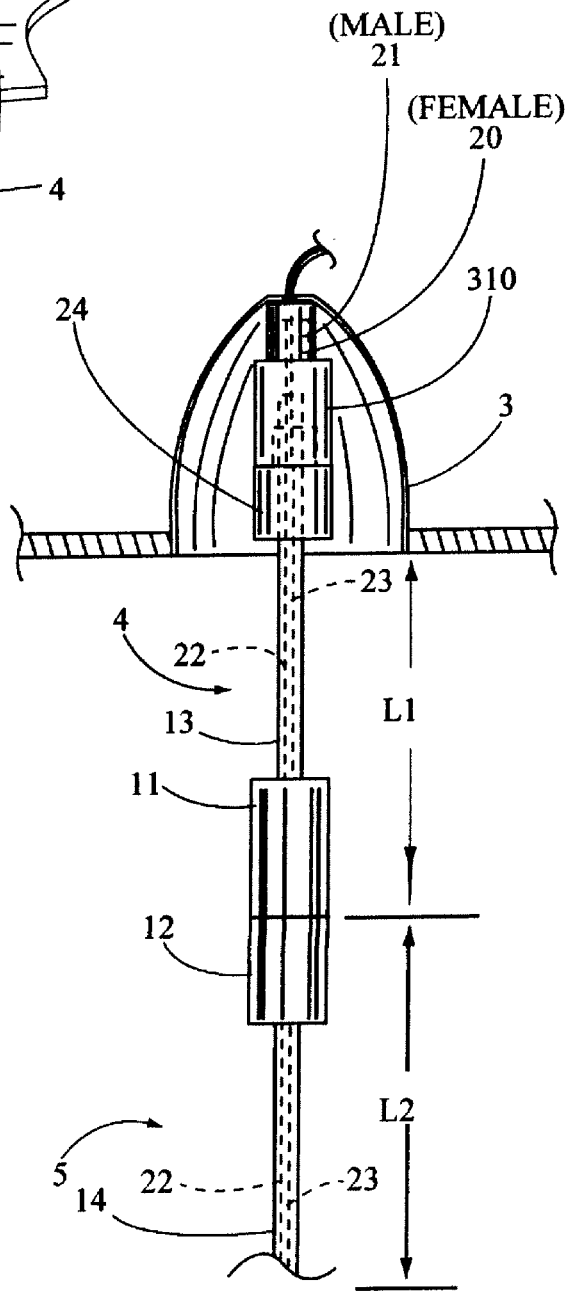
Fig. 2

RECESSED LIGHT EXTENSION SOCKET

CROSS REFERENCE APPLICATIONS

This application is a continuation of application Ser. No. 12/061,729, which was a continuation-in-part of application Ser. No. 11/613,484 filed on Dec. 20, 2006 and issued as U.S. Pat. No. 7,377,817 on May 27, 2008, which was a divisional of application Ser. No. 11/056,178 filed on Feb. 10, 2005 and issued as U.S. Pat. No. 7,153,167 on Dec. 26, 2006.

BACKGROUND OF THE INVENTION

A variety of prior art devices are known for updating ceiling fixtures.

Hampton Bay™ sells a light fixture extension which allows a halogen light fixture to be powered by a standard ceiling light bulb fixture.

U.S. Pat. No. 394,680 (1888) to Dawes discloses a ceiling mounted rod that swivels and to which is attached a power cord and light bulb fixture.

U.S. Pat. No. 684,264 (1901) to Kemmerer discloses a ceiling mounted rod that swivels and supports a bulb fixture at its end.

U.S. Pat. No. 806,516 (1905) to Berry discloses a ceiling mounted two-piece swiveling rod fixture for a bulb fixture.

U.S. Pat. No. 866,473 (1907) to Keefe et al. discloses a ceiling fixture with a swiveling rod and a wire coil end for a bulb fixture.

U.S. Pat. No. 1,263,783 (1918) to Maier discloses a ceiling fixture with a swiveling rod.

U.S. Pat. No. 1,297,211 (1919) to Magress discloses a ceiling fixture with a swiveling rod.

U.S. Pat. No. 1,348,949 (1920) to Johansson discloses a ceiling fixture with a swiveling rod.

U.S. Pat. No. 1,934,624 (1933) to Guth discloses a flexible stem on a ceiling fixture.

U.S. Pat. No. 2,115,898 (1938) to Zagora discloses a swivel-type rod ceiling fixture.

U.S. Pat. No. 2,217,533 (1940) to Wolarsky discloses a telescoping rod light fixture.

U.S. Pat. No. 2,446,736 (1948) to Biller discloses a suspension support for fluorescent lights.

U.S. Pat. No. 2,753,445 (1956) to Thomas et al. discloses a ceiling fixture with a stem.

U.S. Pat. No. 2,767,953 (1956) to Wolar discloses a ceiling fixture and canopy support.

U.S. Pat. No. 5,257,172 (1993) to Erickson discloses a portable AC trouble light.

U.S. Pat. No. 5,317,493 (1994) to Muller et al. discloses an inclined ceiling light fixture.

U.S. Pat. No. 6,113,433 (2000) to Al-Turki discloses an adapter that screws into a bulb socket and has multiple sockets in it.

U.S. Pat. No. 6,409,365 (2002) to Lin discloses a hanging fixture.

U.S. Pat. No. 6,474,829 (2002) to Clodfelter discloses a receptacle mounted light fixture.

U.S. Pat. No. Des. 298,657 (1988) to Flores discloses a dual-ended extension cord.

U.S. Pub. No. 2003/0235049 discloses a decoration multi-bulb fixture.

U.S. Pub. No. 2003/0161149 discloses a collar for a ceiling fixture to enable an extended length bulb to have a diffuser.

What the prior art doesn't suggest is an extender to lower a socket from the ceiling, for example, to a few feet above a restaurant table or a pool table. The present invention provides such a simple, screw-in type extender for light bulb sockets. Although the preferred embodiment shows use with a ceiling mounted recessed type lighting fixture, any threaded lighting socket can be used with the present invention.

SUMMARY OF THE INVENTION

An aspect of the present invention is to provide an easy-to-install rod into a screw type (Edison type bulb or other) socket, thereby extending an Edison socket (or if desired a Bayonet or other type socket) several feet away from the original socket.

Another aspect of the present invention is to provide a mating capability among a series of the extension rods.

Another aspect of the present invention is to provide a shroud over the extended light socket.

Another aspect of the present invention is to provide for either a rigid rod or a flexible extension.

Another aspect of the present invention is to provide a line voltage to low voltage converter in certain embodiments.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 1 is a top perspective view of a ceiling recessed light fixture with an AC/transformer extension adapter installed.

FIG. 2 is a side partial cutaway view of the FIG. 1 embodiment.

FIG. 3 is a partial cutaway view of the lowered bulb of FIG. 1.

Figure 4:
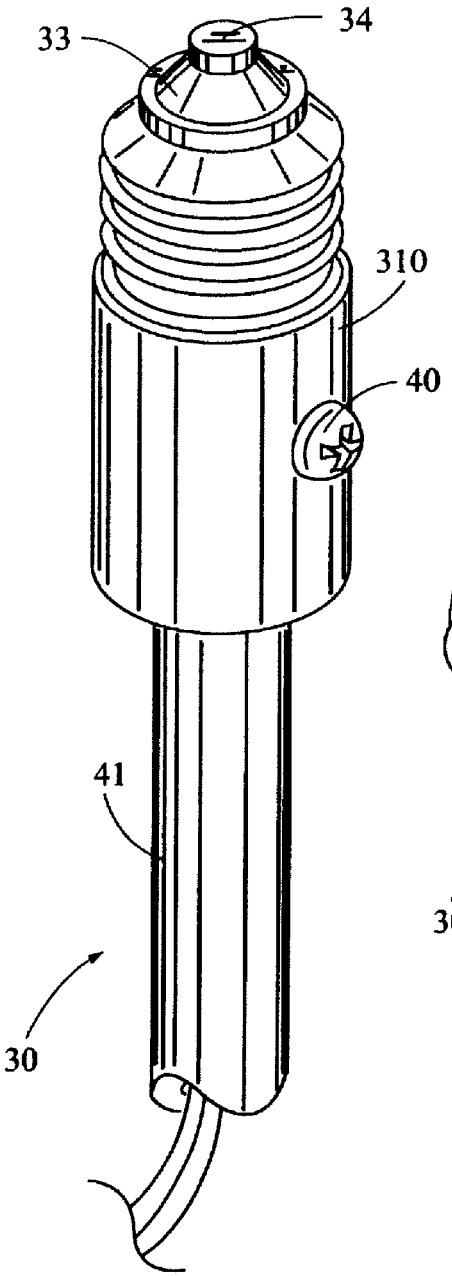
FIG. 4 is a top perspective view of a male adapter.
Figure 5:
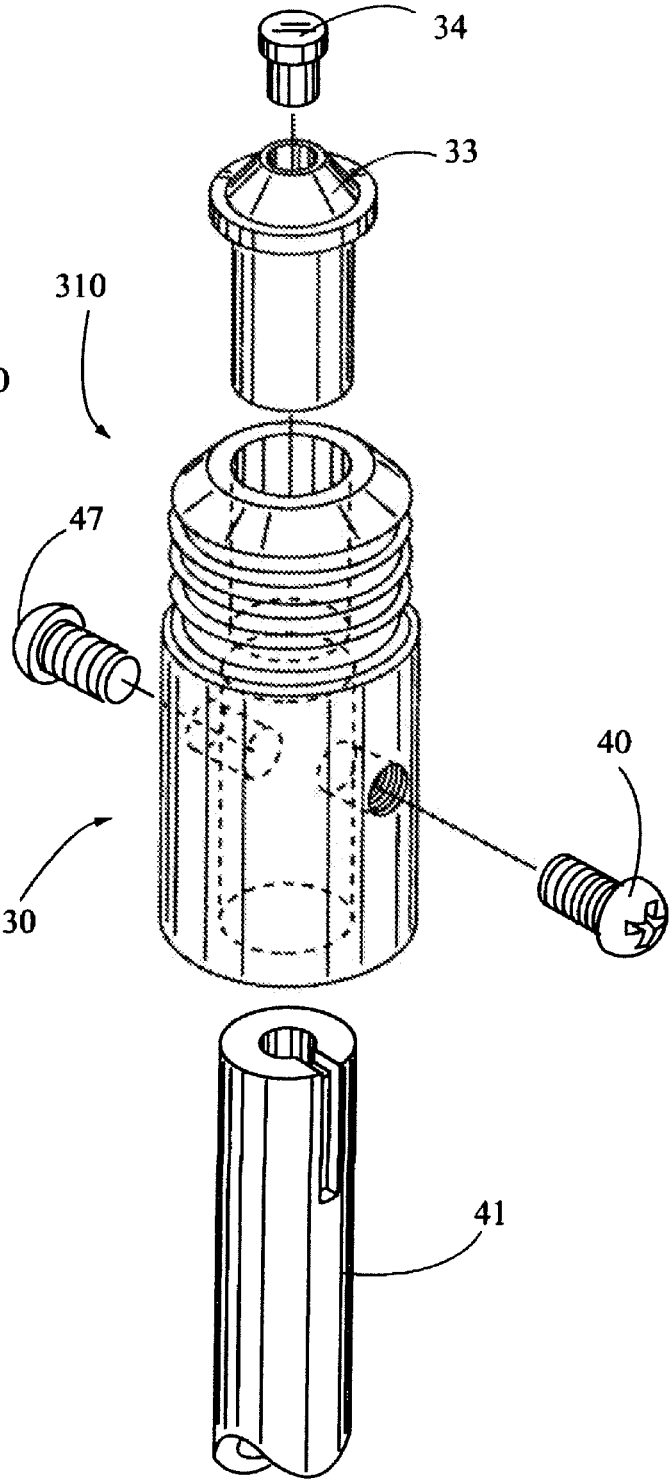
FIG. 5 is an exploded view of FIG. 4, without the two wires.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Referring first to FIGS. 1, 2 a line voltage to low voltage extension adapter 1 consists of an upper extension rod 4 into which a lower extension rod 5 is screwed. The ceiling 2 has a prior art recessed lighting fixture 3 which has a female socket 20. The upper extension rod 4 consists of an upper male adapter 21, a hollow rod 13, and a female socket 11. A line voltage to low voltage transformer 24 converts the line voltage to the low voltage needed for 12 volt lighting. Male adapter 310 presents two AC line voltage wires to the transformer 24. Wires 22, 23 run down the hollow of rod 13 to female socket 11, carrying the low voltage.

In FIG. 3, the lower extension rod 5 consists of male adapter 12 which screws into female socket 11. Hollow rod 14 contains wires 22, 23 which power female socket 9 and bulb 10. A plate 6 (same as FIG. 9) connects to rod 14. Brackets 7 support a shroud 8. User can select lengths L1, L2.

Referring next to FIGS. 4-7 an AC system is shown, wherein the height of a standard AC bulb can be lowered from a standard ceiling fixture.

FIGS. 4, 5, 6, 7 represent AC extension rod 30. Extension rod 30 consists of a male adapter 310, a hollow, non-conductive rod 41, and a female socket 311. Nominally rod 41 can be made of plastic. The male adapter 310 is a conductor having a hollow 50 to receive the rod 41. A screw 47 threads through threaded hole 45 into recess 46, thereby securing the rod 41 via its recess 46. Threads 32 are standard AC bulb socket threads 1 1/16 OD, 7 threads per inch. A conductive button 34 is housed in the center insulator 33. The uninsulated tip 35 of the hot insulated wire 42 is soldered to the conductive button 34 in a known manner. The insulated neutral wire 37 has an uninsulated end 38 which fastens to the conductive male end 31 via screw 40 threaded through hole 39. The pair of insulated wires 37, 42 are housed in the hollow 500 of rod 41 and hollow 36 of male end 31.

The conductive female end 600 is insulated from conductive button 340 at its base 602 via center insulator 607 in a known manner. Threads 601 in hollow 605 receive a standard AC bulb or a male end 31 with threads 32.

Figure 9:
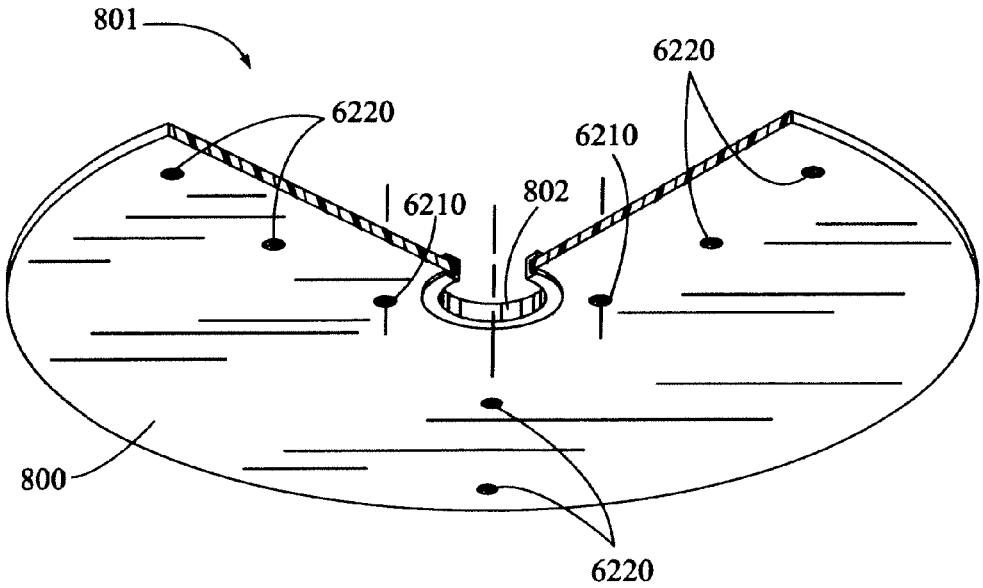
FIG. 9 is a partial cutaway view of a lampshade holder plate.

Optionally female socket 311 includes holes 620 which receive screws 621 thereby fastening a plate or a shroud as seen in FIG. 9.

FIG. 9 shows one method for mounting a shroud. Holes 6210 receive screws 621 of FIG. 7. Plate 800 then accepts the brackets 7 of FIG. 1, via mounting holes 6220 which in turn support shroud 8 of FIG. 1. A rod 41 fits in hollow 802, thereby forming a shroud assembly 801.

Figure 7:
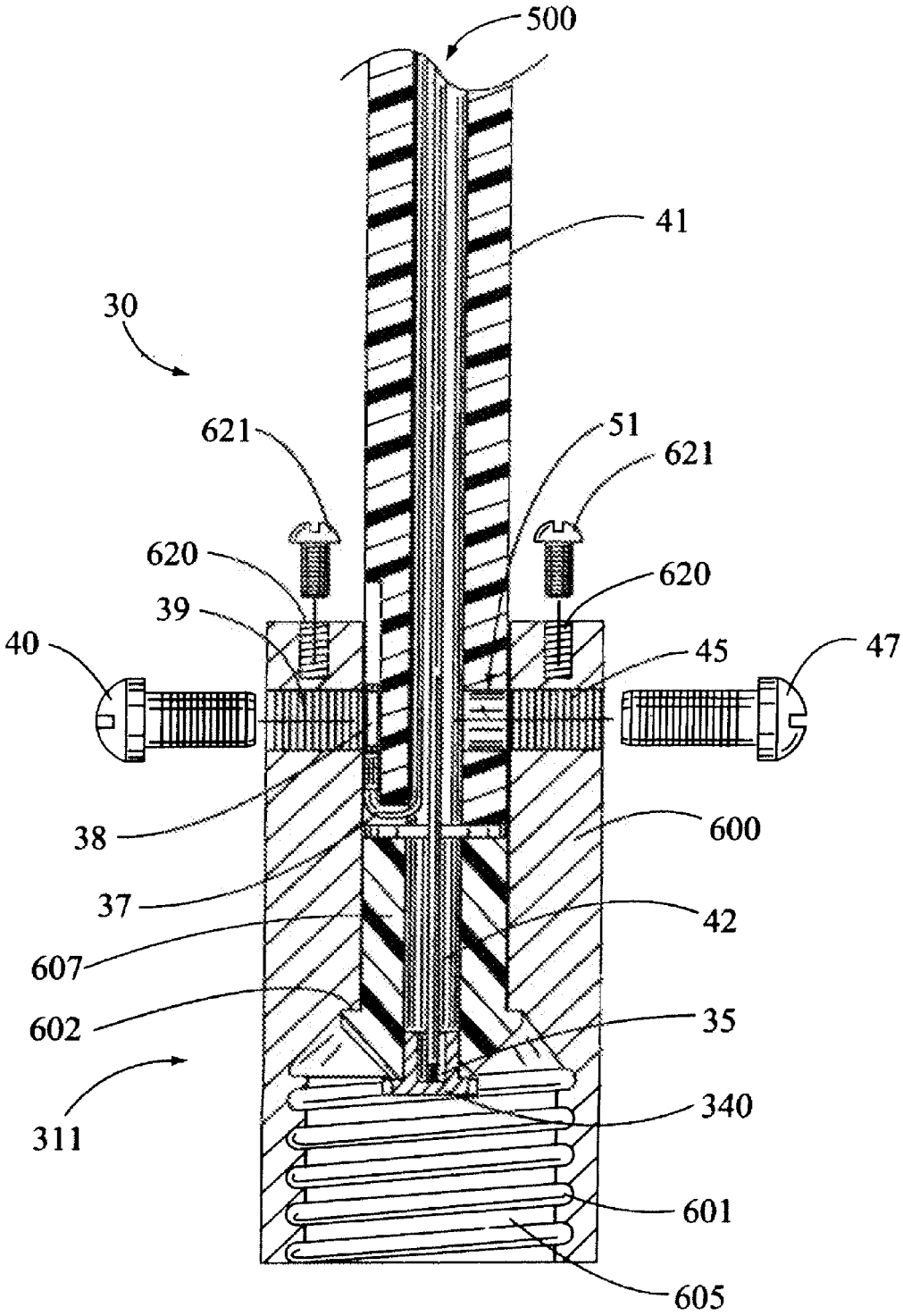
FIG. 7 is a cross sectional view of the female end.
Figure 8:
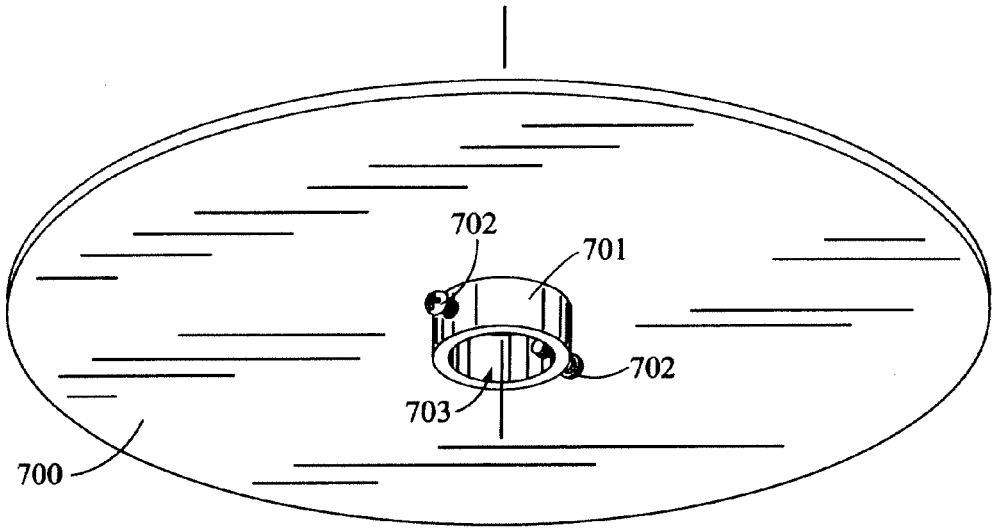
FIG. 8 is a perspective view of a ceiling closeout plate.

The plate 700 in FIG. 8 is preferably mounted with the collar 701 side facing the female end 600 of FIG. 7. The collar 701 would be placed around the rod 41 while it was detached from either the male end 31 or the female end 600. Locking screws 702 can secure the plate 700 anywhere along rod 41 via hollow 703, to close out the recessed lighting fixture recess in the ceiling.

Figure 10:
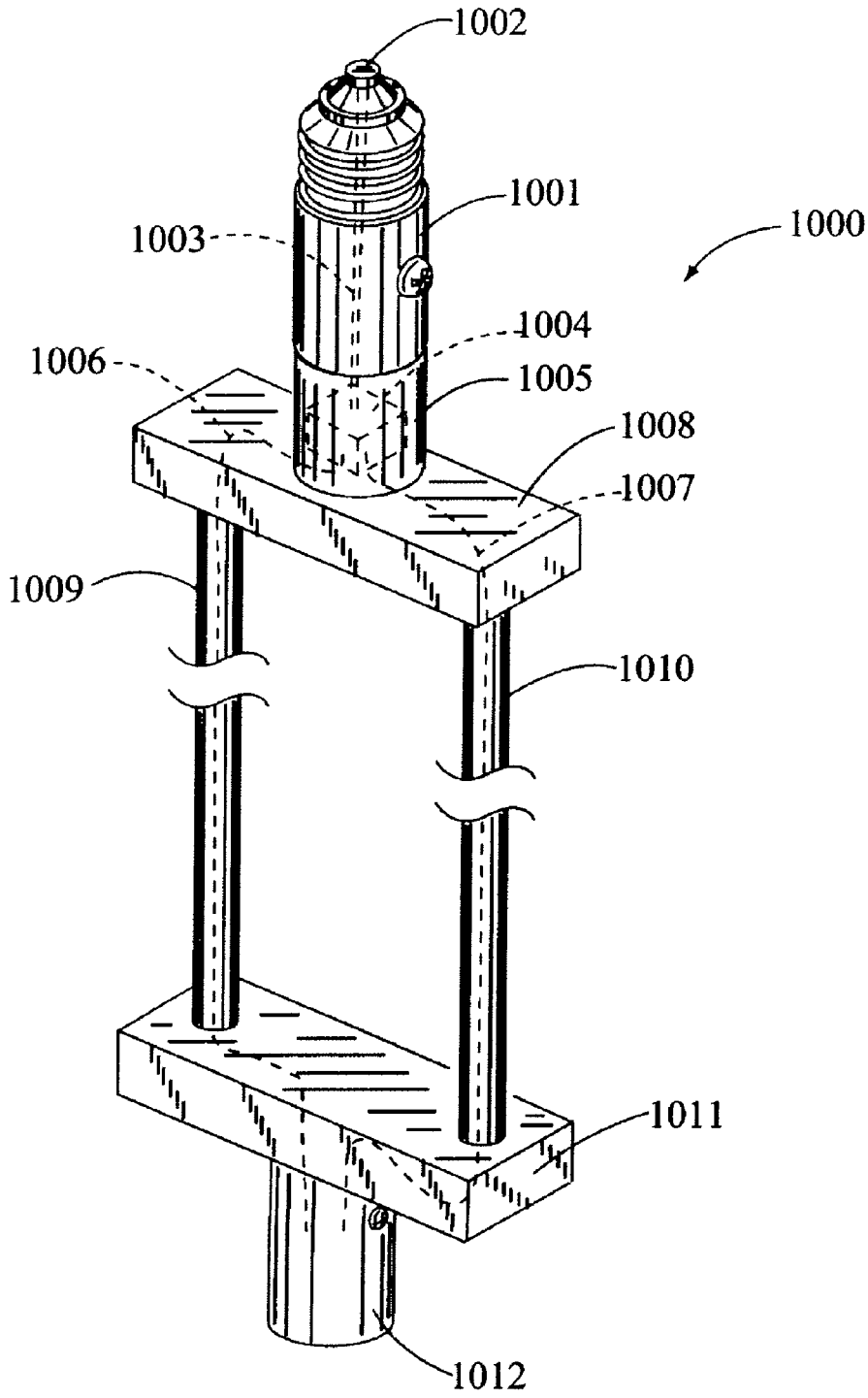
FIG. 10 is a top perspective view of a line voltage to low voltage alternate embodiment.

Referring next to FIG. 10 a line voltage to low voltage extension rod 1000 consists of a male adapter 1001 with a standard contact button 1002. Wires 1003 carry AC voltage to a transformer 1004 housed in a cylindrical housing 1005. Low voltage wires 1006, 1007 travel through cross bracket 1008 and then down hollow rods 1009, 1010, and then through cross bracket 1011 and into female socket 1012, which would normally hold a 12 volt bulb.

Figure 6:
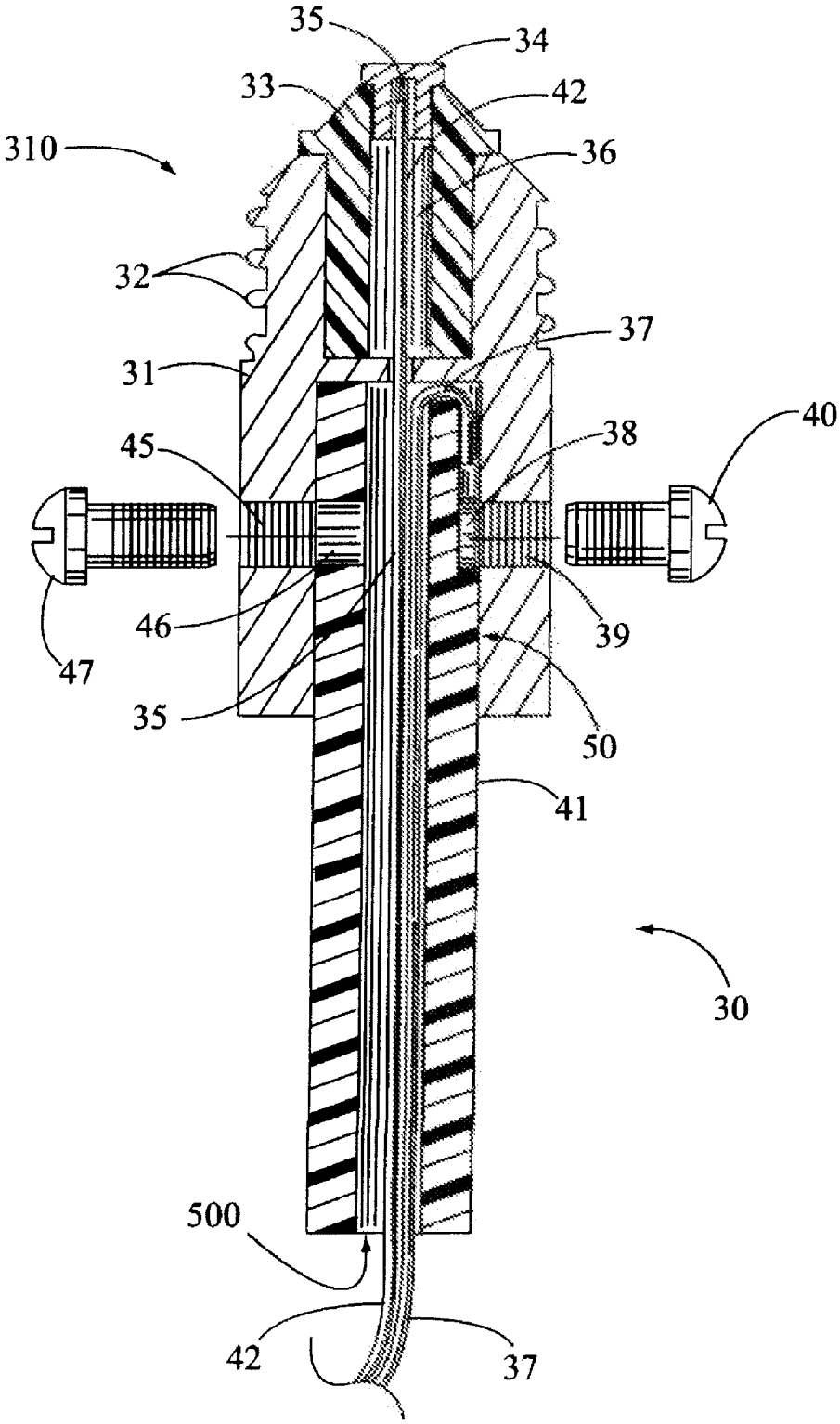
FIG. 6 is a cross sectional view of the male end.
Figure 11:
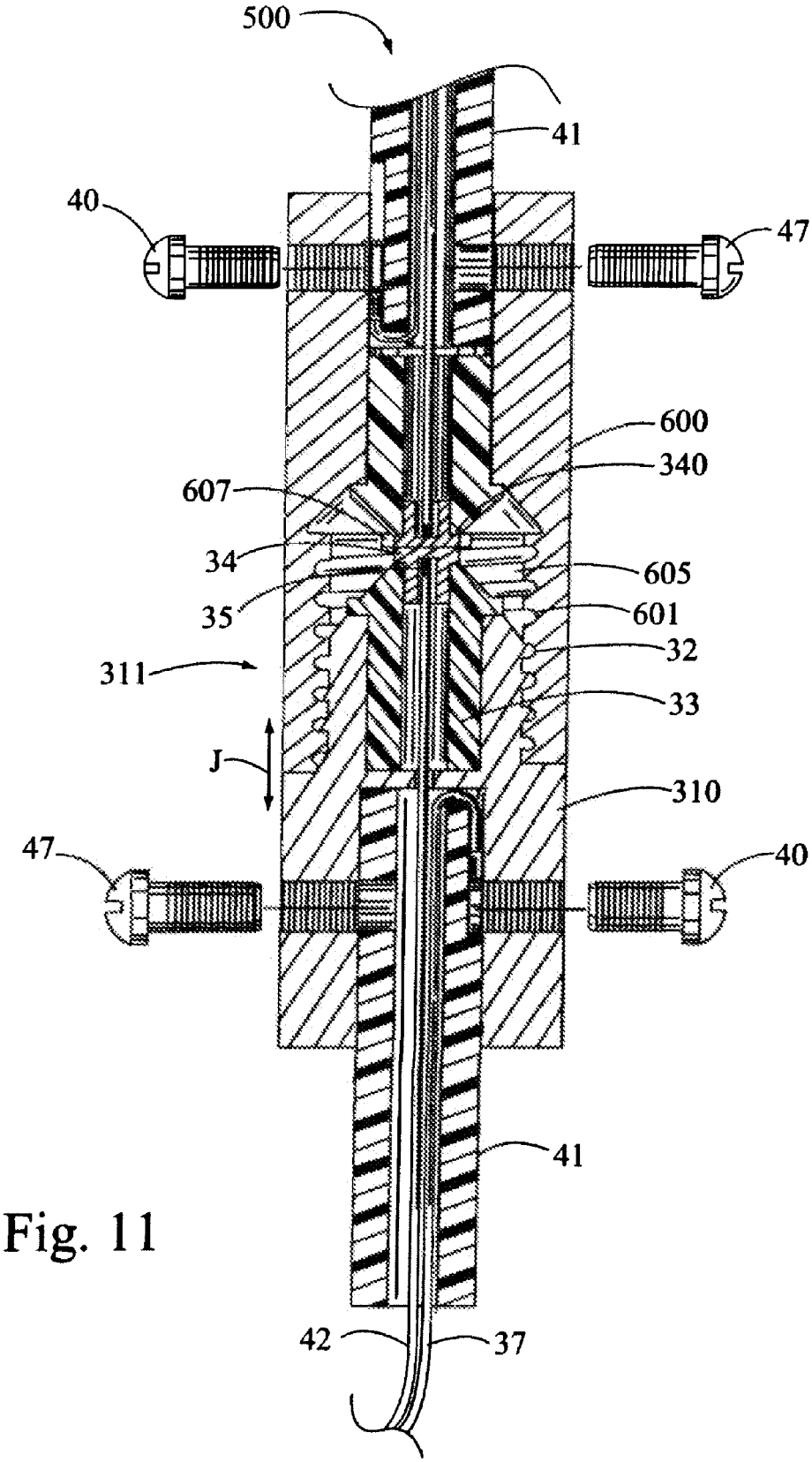
FIG. 11 is a cross sectional view of a mated male end female pair.

Referring next to FIG. 11, the male adapter 310 of FIG. 6 is shown screwed into the female socket 311 of FIG. 7. There is formed a smooth joint J along the exterior mated surfaces of 310 and 311.

Figure 12:
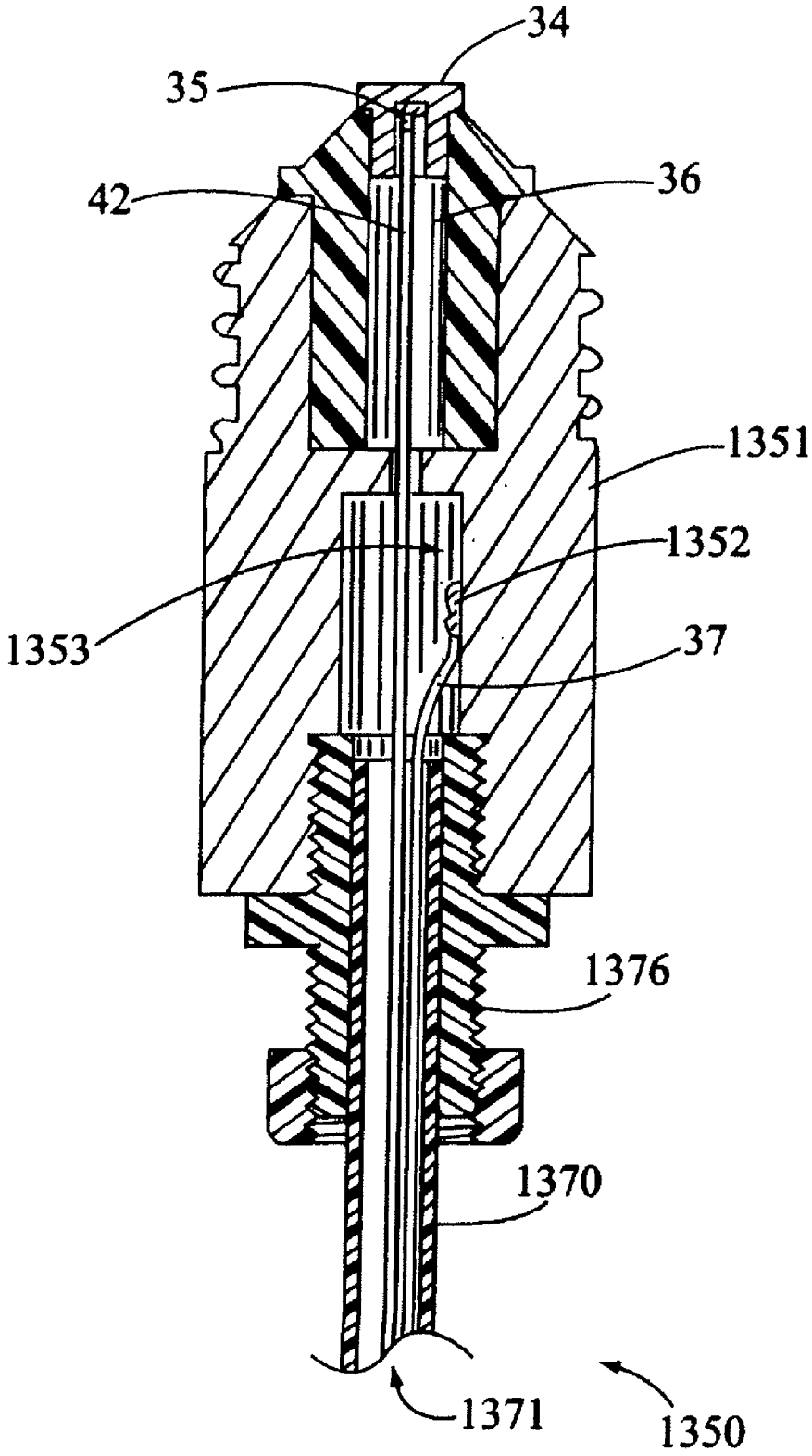
FIG. 12 is a cross sectional view of an alternate flexible embodiment male end.
Figure 13:
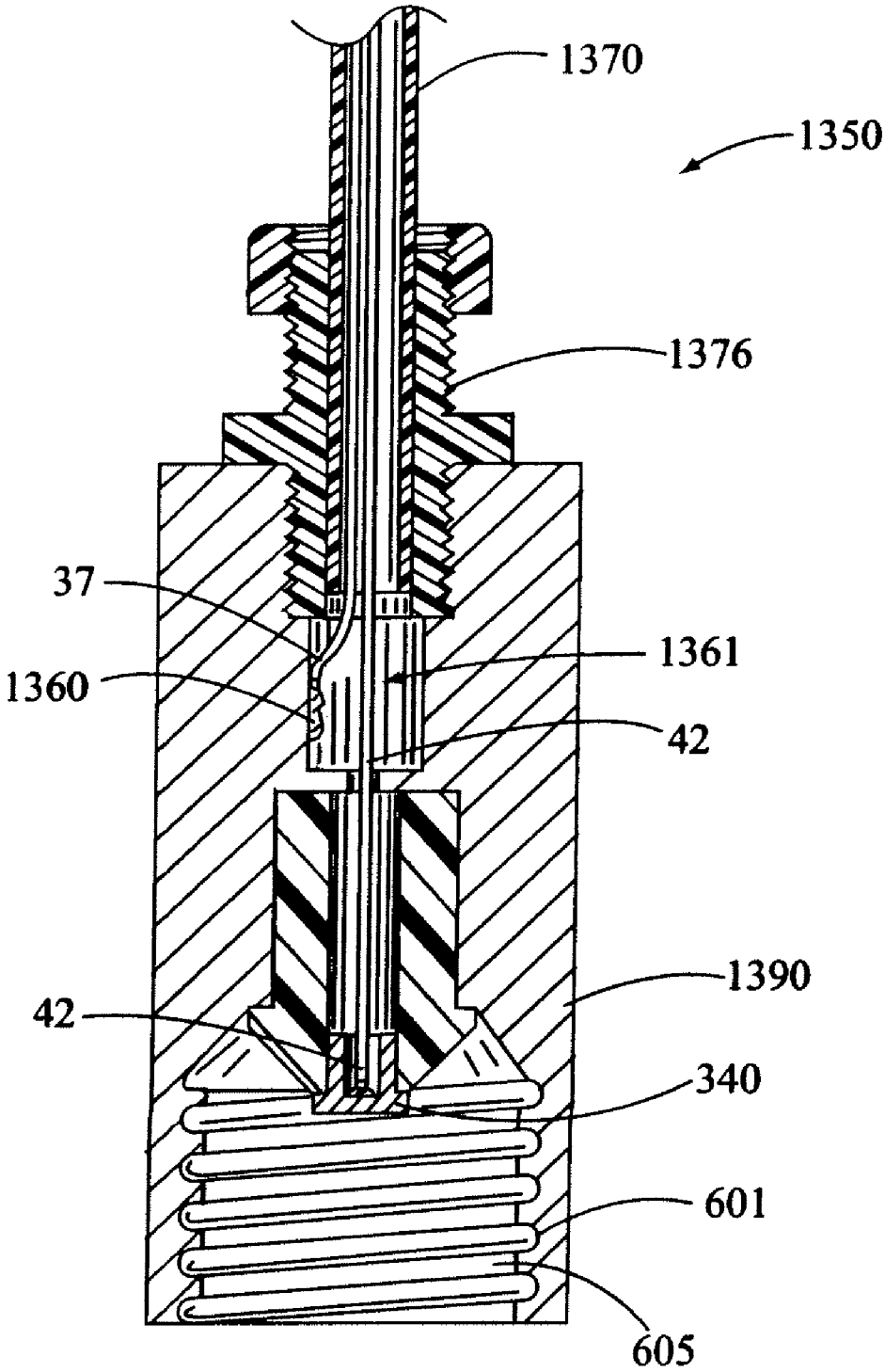
FIG. 13 is a cross sectional view of the female end of the FIG. 12 embodiment.

Referring next to FIGS. 12, 13 a two conductor flexible conductor 1350 is shown. The male adapter 1351 has the same contact button 34 as in FIG. 6. However, the neutral wire 37 has a solder connection 1352 to an inside wall of a hollow 1353 of the male adapter 1351.

The cable 1370 has a hollow 1371, and the cable 1370 is flexible, wherein strain relief 1376 can provide structural integrity for the weight of the female socket 1390. Strain relief connectors 1376 secure the cable 1370 to the male/female ends. The solder connection 1360 is in hollow 1361 of female socket 1390.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A first extension adapter for a female electrical socket in a ceiling recessed lighting fixture, said first extension adapter comprising:

a male adapter housing having an upper end and a lower end;

said male adapter housing upper end comprising a threaded male end and an electrical connector suited to screw into the recessed lighting fixture;

said electrical connector comprising a conductive button at a tip of the threaded male end;

said male adapter housing lower end containing a space for a cable;

a female adapter housing having an upper end and a lower end;

said female adapter upper end containing a space for the cable;

said female adapter lower end comprising a female hollow having threads to accept male threads and an electrical connector; and said cable connecting the electrical connector of the male adapter housing to the electrical connector of the female adapter housing;

wherein the female adapter lower end is at a chosen distance from the female electrical socket; and substantially all of the weight of the female adapter housing is supported by said cable.

2. The adapter of claim 1, wherein the cable further comprises a hollowed, rigid rod.

3. The adapter of claim 1, wherein the cable is flexible.

4. The adapter of claim 1, wherein the cable supports a shroud.

5. The adapter of claim 1 further comprising a plate associated with the male adapter housing and suited to cover an opening in the recessed lighting fixture.

6. The adapter of claim 5, wherein the plate further comprises a mounting collar with a fastener to secure the plate to the cable.

7. The adapter of claim 1 further comprising a second extension adapter screwed into the female hollow, said second extension adapter having a male end comprising a threaded end and an electrical conductor and a distal end with a female adapter connected to the male end via a cable.

8. The adapter of claim 1, wherein the cable is removably attached to the male adapter and the female adapter housings.

9. An extension adapter for a female electrical socket in a ceiling recessed lighting fixture, said extension adapter comprising:

a male adapter means having a threaded end with an electrical connector suited to screw into the recessed lighting fixture, wherein the male adapter means functions to screw into the female electrical socket and conduct power therefrom;

said male adapter means having a housing means with a space for a cable containing wires which function to electrically connect the electrical connector to a female adapter means;

said cable being connected to the male adapter means and the female adapter means and functioning to extend a position of a bulb away from the female electrical socket;

said female adapter means further comprising a lower end having female socket with an electrical connector connected to the wires from the male adapter electrical connector; and said female adapter means functions to support the bulb at a chosen distance below the female electrical socket.

10. The adapter of claim 9, wherein the cable further comprises a hollowed, rigid rod.

11. The adapter of claim 9, wherein the cable is flexible.

12. A first extension adapter for a female electrical socket for a ceiling recessed lighting fixture, said first extension adapter comprising:

a male adapter having a threaded end with a conductive button at a tip of the threaded end;

said male adapter having male screw threads and an outside diameter of 1 1/16 inch and having a housing with an internal wire which electrically connects the conductive button to a female adapter via an intermediary cable;

said intermediary cable being connected to the male adapter housing and a female adapter housing;

said female adapter housing further comprising a female socket with female screw threads with a conductive button connected to the wire from the male adapter conductive button;

wherein the intermediary cable further comprises a flexible cable;

wherein the male adapter housing further comprises a cylindrical shape;

wherein the intermediary cable is housed within an opening in the male adapter housing and an opening in the female adapter housing; and wherein the female socket of the female adapter housing receives a bulb thread and supports the female socket at a chosen distance away from the female electrical socket of the ceiling recessed lighting fixture.

13. A first extension adapter for a female electrical socket for a ceiling recessed lighting fixture, said first extension adapter comprising:

a male adapter having a threaded end with a conductive button at a tip of the threaded end;

said male adapter with male screw threads and an outside diameter of 1 1/16 inch and having a housing with an internal wire which electrically connects the conductive button to a female adapter via an intermediary cable;

said intermediary cable being connected to the male adapter housing and a female adapter housing;

said female adapter housing further comprising a female socket with female screw threads matching the male screw threads and having an inside diameter of 1 1/16 inch with a conductive button connected to the wire from the male adapter conductive button;

wherein the intermediary cable further comprises a hollowed, non-conductive, flexible cable;

wherein the male adapter housing further comprises a cylindrical shape which conforms to a similar cylindrical shape of the female adapter housing;

wherein the intermediary cable is housed within an opening in the male adapter housing and an opening in the female adapter housing; and wherein the female socket of the female adapter housing receives an identical bulb thread as is accepted by the female electrical socket of the ceiling recessed lighting fixture and provides the female socket at a chosen distance away from the female electrical socket.

14. The adapter of claim 13 further comprising a plate connected to the female housing, said plate supporting a shroud.

15. The adapter of claim 13 further comprising a plate connected to the intermediary cable, said plate supporting a shroud.

16. The adapter of claim 13 further comprising a plate associated with the male adapter and suited to cover an opening in the ceiling recessed lighting fixture.

17. The adapter of claim 16, wherein the plate further comprises a mounting collar with a fastener to secure the plate to the intermediary cable.

18. The adapter of claim 13 further comprising a neutral wire connected from the male adapter housing to the female adapter housing via the intermediary cable.

19. The adapter of claim 13 further comprising a second extension adapter screwed into the female adapter, said second extension adapter having a male threaded end with a conductive button at a tip of the male threaded end and a distal end with a female adapter, said threaded ends of said second extension adapter having the same outside diameters as the first extension adapter.

20. The adapter of claim 13, wherein the intermediary cable is removably attached to the male adapter and the female adapter housings.

21. The adapter of claim 13, wherein the male and female adapter housings each have a strain relief connector to removably secure the intermediary cable.

22. The adapter of claim 13, wherein each of the male and female adapter housings have a center insulator supporting their respective conductive buttons.

23. The adapter of claim 18, wherein the neutral wire has a solder connection to an inside wall of the male adapter and to an inside wall of the female adapter.

* * * * *